US005793878A

United States Patent [19]

Chang

[11] Patent Number: 5,793,878

[45] Date of Patent: Aug. 11, 1998

[54] HEADSET MICROPHONE HAVING A LOCATION APPARATUS

[76] Inventor: Ching-Wen Chang, No. 22, 23rd, Road, Taichung Industrial Park, Taichung, Taiwan

[21] Appl. No.: 869,955

[22] Filed: Jun. 5, 1997

[51] Int. Cl.[6] ..... H04K 25/00

[52] U.S. Cl. ..... 381/183; 381/187

[58] Field of Search ..... 381/183, 187, 381/168, 169; 379/430; 455/90

[56] References Cited

U.S. PATENT DOCUMENTS 4,634,816 1/1987 O'Malley et al. ..... 381/187

5,381,486 1/1995 Ludeke et al. ..... 381/187

5,446,788 8/1995 Lucey et al. ..... 379/430

*Primary Examiner*—Sinh Tran

*Attorney, Agent, or Firm*—Browdy and Neimark

[57] ABSTRACT

A microphone of the headset is composed of a base which is provided with a plurality of locating projections. The base of the microphone is fastened pivotally with a recess of the base of the ear cushion of the headset such that the locating projections of the base of the microphone are engaged with a locating portion of the recess of the ear cushion, and that the microphone can be swiveled and located as desired.

3 Claims, 3 Drawing Sheets

HEADSET MICROPHONE HAVING A LOCATION APPARATUS

FIELD OF THE INVENTION

The present invention relates generally to a headset, and more particularly to a microphone of the headset.

BACKGROUND OF THE INVENTION

The conventional headsets are generally provided with a microphone which is attached thereto for two-way communication. The microphone can be adjusted in position; nevertheless it is not provided with a device capable of locating the microphone effectively.

SUMMARY OF THE INVENTION

It is therefore the primary objective of the present invention to provide a headset with a microphone attached thereto such that the microphone can be effectively adjusted in position relative to the headset.

It is another objective of the present invention to provide a headset microphone with a locating apparatus which is simple in construction and can be easily assembled.

In keeping with the principle of the present invention, the foregoing objectives of the present invention are attained by a headset microphone, which consists of a base, an extension tube fastened at one end thereof with the base, a head fastened with another end of the extension tube. The base of the microphone is provided with a plurality of locating projections. One of two ear cushions of the headset is provided with a recess having a locating portion engageable securely with the locating projections of the base of the microphone.

The foregoing objectives, features and functions of the present invention will be more readily understood upon a thoughtful deliberation of the following detailed description of the embodiments of the present invention with reference to the accompanying drawings.

DETAILED DESCRIPTION OF THE INVENTION

Figure 1:
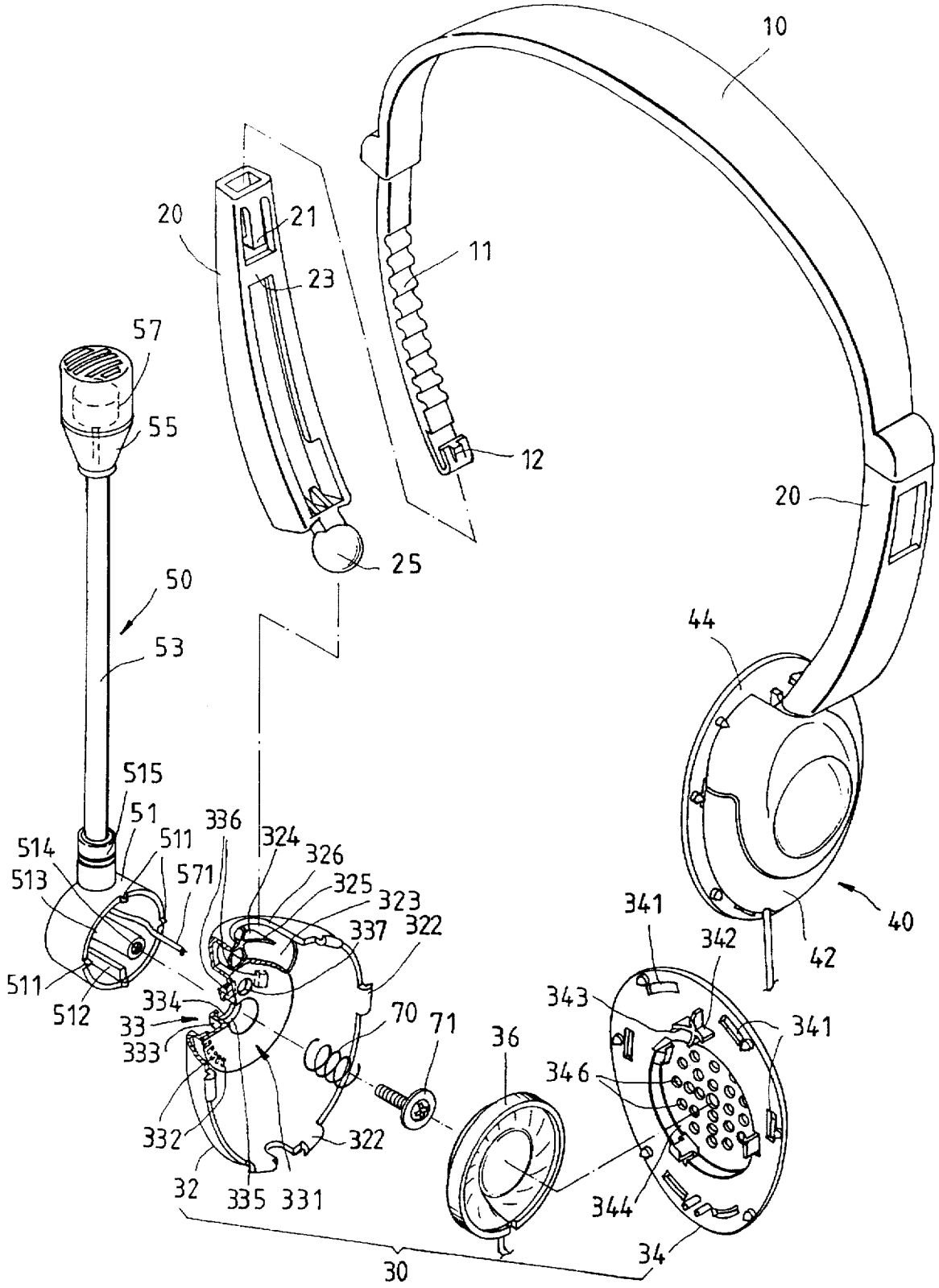
FIG. 1 shows a partial exploded view of a first preferred embodiment of the present invention.
Figure 2:
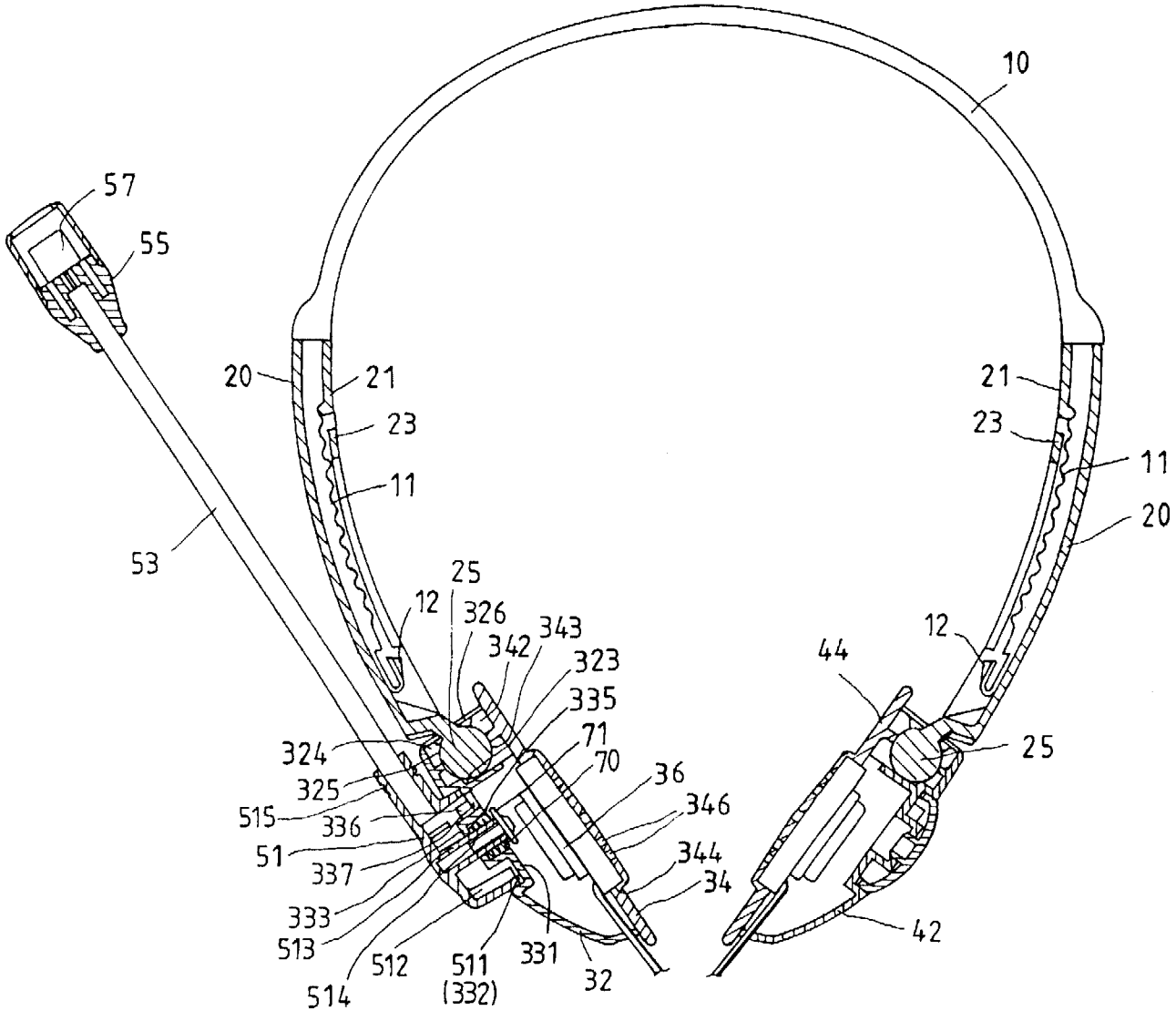
FIG. 2 shows a partial sectional view of the present invention in combination.

As shown in FIGS. 1 and 2, a headset embodied in the present invention is composed of a headband 10, two connection members 20, a first ear cushion 30, a second ear cushion 40, and a microphone 50.

The headband 10 is of an inverted U-shaped construction and provided respectively at both free ends thereof with a retaining portion 11 of a corrugated construction and an inverted hook 12 located at the free end of the retaining portion 11.

The connection members 20 of a hollow construction are provided with an open top and are engaged respectively with the retaining portion 11 of the headband 10 such that the connection members 20 can be relocated in relation to the headband 10. The connection members 20 are provided with a retaining block 21 engageable with the retaining portion 11 of the headband 10. The connection members 20 are further provided with an arresting block 23 which is engaged with the hook 12 of the headband 10 to prevent the connection members 20 from being disengaged with the headband 10. The connection members 20 are further provided respectively at one end thereof with a pivoting portion 25 of a spherical construction.

The first ear cushion 30 and the second ear cushion 40 are similar in construction. For this reason, only the first ear cushion 30 will be described explicitly. The first ear cushion 30 is composed of a base 32 and a face plate 34. The base 32 is provided with a plurality of retaining projections 322, and a cell 323 having in the bottom wall thereof a cruciform rib 324. The rib 324 is provided with a holding face 325 of an arcuate construction. The base 32 is further provided with a slot 326 in communication with the cell 323. The base 32 is still further provided with a round recess 33 having in the bottom thereof a locating portion 331 consisting of a plurality of protuberances 332. The recess 33 is provided at the center thereof with a tubular projection 333 having an axial hole 334 with a stepped portion 335. The recess 33 is further provided with two stopping pieces 336 which are connected respectively at one end thereof with the outer wall of the tubular projection 333. The stopping pieces 336 are provided respectively at the center thereof with a through hole 337.

The face plate 34 is provided in the periphery thereof with a plurality of through holes 341, which are engaged with the retaining projections 322 of the base 32. The face plate 34 is further provided with a cruciform rib 342 corresponding in location to the cell 323 of the base 32. The rib 342 is provided with a holding face 343 of an arcuate construction. The face plate 34 is still further provided with a recess 344 for locating a loudspeaker 36. The recess 344 is provided in the bottom wall thereof with a plurality of vent holes 346.

The second ear cushion 40 is composed of a base 42 and a face plate 44, which are similar in construction to the base 32 and the face plate 34 of the first ear cushion 30 described above.

The microphone 50 is composed of a base 51, an extension tube 53, a head 55, and a sound pick-up device 57.

The base 51 is cylindrical in construction and is provided in one end edge thereof with a plurality of locating projections 511 which are arranged equidistantly. The base 51 is further provided in the inner wall thereof with a retaining piece 512. The base 51 has a shaft 513 extending along the longitudinal direction of the base 51 and having a threaded axial hole 514. The base 51 is further provided with a connection tube 515 fastened to the outer wall of the base 51 such that the connection tube 515 is in communication with the interior of the base 51.

The extension tube 53 is fastened at one end thereof with the connection tube 515, and at another end thereof with the head 55 in which the sound pick-up device 57 is located. A signal wire 571 is connected with the sound pick-up device 57 via the through hole 337 of the base 32 and the extension tube 53.

In combination, the base 51 of the microphone 50 is located in the recess 33 of the base 32 of the first ear cushion 30 such that the shaft 513 of the base 51 is received in the axial hole 334 of the tubular projection 333 of the recess 33, and that the shaft 513 is fitted into a spring 70, and further that the threaded axial hole 514 of the shaft 513 is engaged with a fastening screw 71 which is urged by one end of the spring 70. The spring 70 has another end urging the stepped portion 335 of the recess 33. As a result, the locating projections 511 of the base 51 of the microphone 50 are retained securely in the locating portion 331. Thereafter, the connection member 20 is fitted over the retaining portion 11 of the headband 10 such that the pivoting portion 25 is located in the cell 323 of the base 32 of the first ear cushion 30, and that the face plate 34 of the first ear cushion 30 is joined with the base 32, and further that the retaining projections 322 of the base 32 are engaged securely with the through holes 341 of the face plate. The second ear cushion 40 is assembled in a way similar to the one as described above.

The microphone 50 is located such that the microphone 50 can be swiveled on the shaft 513 serving as a pivot. The locating projections 511 of the base 51 of the microphone 50 are urged by the spring 70 to engage the locating portion 331 securely. In addition, when the microphone 50 is swiveled to a certain extent, the retaining piece 512 of the base 51 of the microphone 50 is stopped by the arresting piece 336 of the recess 33 so as to prevent the microphone 50 from turning clockwise or counterclockwise without restraint. If the microphone 50 is allowed to keep turning without restraint, the signal wire 571 of the sound pick-up device 57 is likely to be twisted.

Figure 3:
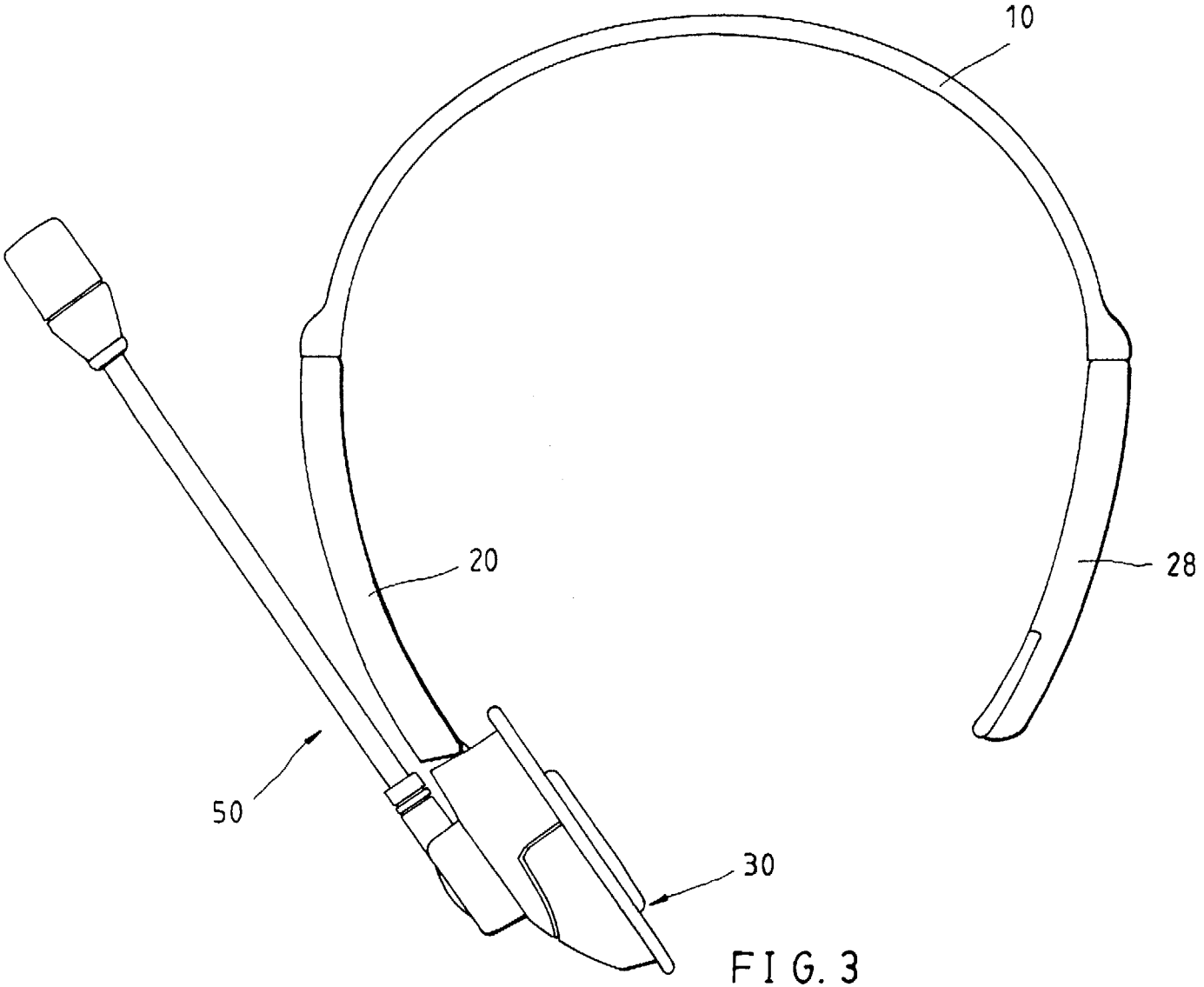
FIG. 3 shows a perspective view of a second preferred embodiment of the present invention.

As shown in FIG. 3, the present invention may be applied to a headset having only one ear cushion 30 which is fastened with one of two connection members 20 and 28.

What is claimed is:

1. A headset comprising:

a headband having two free ends;

at least one connection member fastened adjustably with one of said two free ends of said headband;

at least one ear cushion fastened with said connection member and composed of a base and a face plate; and a microphone composed of a base, an extension tube fastened at one end thereof with said base, a head fastened with another end of said extension tube, and a sound pick-up device located in said head, said base of said microphone being fastened pivotally with said base of said ear cushion such that said microphone can be swiveled in relation to said ear cushion;

wherein said base of said ear cushion is provided with a recess having a locating portion, a plurality of arresting pieces, and a tubular projection provided with an axial hole which is in turn provided with a stepped portion;

wherein said base of said microphone is provided with a plurality of locating projections, a retaining piece, and a shaft having a threaded axial hole;

wherein said base of said microphone is located in said recess of said base of said ear cushion such that said shaft of said base of said microphone is received in said axial hole of said tubular projection of said base of said ear cushion, and that said locating projections of said base of said microphone are engaged securely with said locating portion of said recess of said base of said ear cushion, and further that said microphone can be swiveled on said shaft of said base of said microphone.

2. The headset as defined in claim 1, wherein said shaft of said base of said microphone is provided with a biasing means fitted thereover; and wherein said shaft of said base of said microphone is fastened by a fastening screw which is engaged with said threaded axial hole of said shaft such that said fastening screw is urged by one end of said biasing means, with another end of said biasing means urging said stepped portion of said axial hole of said recess of said ear cushion.

3. The headset as defined in claim 1, wherein said retaining piece of said base of said microphone is stopped by said arresting piece of said recess of said ear cushion so as to prevent said microphone from turning clockwise or counterclockwise without restraint.

* * * * *